US007958651B2

(12) United States Patent
Maniha

(10) Patent No.: US 7,958,651 B2
(45) Date of Patent: Jun. 14, 2011

(54) CLOTHES DRYER RAKE

(76) Inventor: Allan M. Maniha, Houston, TX (US)

( * ) Notice: Subject to any disclaimer, the term of this patent is extended or adjusted under 35 U.S.C. 154(b) by 0 days.

(21) Appl. No.: 11/437,200

(22) Filed: May 19, 2006

(65) Prior Publication Data

US 2007/0266588 A1 Nov. 22, 2007

(51) Int. Cl.
*F26B 11/02* (2006.01)

(52) U.S. Cl. ..... 34/86; 34/603; 34/604; 68/139; 68/13 R; 439/484; 510/515; 2/181; 81/13; 454/367

(58) Field of Classification Search ..... 34/236, 34/60, 80, 90, 595, 601, 242, 86, 603, 604; 53/210; 56/340, 400–12; 284/508; 68/139, 68/13 R; 439/484; 2/181; 81/13; 454/367; 510/515; 539/484
See application file for complete search history.

(56) References Cited

U.S. PATENT DOCUMENTS

| | | | | | |
|---|---|---|---|---|---|
| 431,433 | A | * | 7/1890 | Brick | 294/50.8 |
| 1,095,585 | A | * | 5/1914 | Mack | 56/328.1 |
| 1,160,282 | A | * | 11/1915 | Harris | 56/400.05 |
| 1,397,956 | A | * | 11/1921 | Gilliland | 56/358 |
| 1,420,548 | A | * | 6/1922 | Hilton | 414/721 |
| 1,441,021 | A | * | 1/1923 | Pearson | 56/10.2 R |
| 1,480,003 | A | * | 1/1924 | Morgan | 299/63 |
| 1,561,794 | A | * | 11/1925 | Peterson | 188/141 |
| 1,621,276 | A | * | 3/1927 | Richardson | 56/400.17 |
| 1,643,946 | A | * | 10/1927 | Friedl | 188/249 |
| 1,663,579 | A | * | 3/1928 | Anderberg et al. | 303/6.01 |
| 1,675,723 | A | * | 7/1928 | Morgan | 299/33 |
| 1,697,289 | A | * | 1/1929 | Rocquin | 56/400.17 |
| 1,706,962 | A | * | 3/1929 | Morgan | 299/74 |
| 1,769,444 | A | * | 7/1930 | Mallory | 267/198 |
| RE17,810 | E | * | 9/1930 | Bell et al. | 56/400.17 |
| RE17,980 | E | * | 2/1931 | Bell et al. | 56/400.17 |
| 1,857,060 | A | * | 5/1932 | McBerty | 219/97 |
| 1,858,089 | A | * | 5/1932 | Howey | 198/632 |
| 1,861,001 | A | * | 5/1932 | Fageol | 180/54.1 |
| 1,978,717 | A | * | 10/1934 | Oppenheim | 56/400 |
| 2,002,661 | A | * | 5/1935 | French | 404/115 |
| 2,062,472 | A | * | 12/1936 | Neuhausen | 403/190 |
| 2,072,992 | A | * | 3/1937 | Potemkin | 56/400.18 |
| 2,099,053 | A | * | 11/1937 | Donnan | 56/400.07 |
| 2,103,305 | A | * | 12/1937 | Thomas | 73/39 |
| 2,193,436 | A | * | 3/1940 | Stratford | 56/400.13 |
| 2,237,002 | A | * | 4/1941 | Kelley | 56/400 |
| 2,238,840 | A | * | 4/1941 | Weishaar | 56/16.1 |
| 2,288,496 | A | * | 6/1942 | Swedberg | 414/704 |
| 2,294,157 | A | * | 8/1942 | Brooke | 56/400.17 |
| 2,301,524 | A | * | 11/1942 | Cooper | 56/400.13 |
| 2,304,873 | A | * | 12/1942 | Bangert | 56/249 |
| 2,329,708 | A | * | 9/1943 | Fetterman | 56/400.13 |

(Continued)

FOREIGN PATENT DOCUMENTS

DE 3340871 A1 * 5/1985

(Continued)

*Primary Examiner* — Stephen M. Gravini
(74) *Attorney, Agent, or Firm* — The Matthews Firm

(57) ABSTRACT

An apparatus for retrieving articles from a dryer or otherwise retrieving article from places not easily accessible is described herein. The apparatus comprises a handle with a head attached thereto. The head can be mounted so as to be detachable, swivable, or interchangeable. The handle can be telescoping for further reaching capability or foldable for easy storage. The apparatus can provide illumination as well as be configured to reach into small, various shaped, and otherwise not easy to reach locations.

17 Claims, 4 Drawing Sheets

U.S. PATENT DOCUMENTS

| | | | | | |
|---|---|---|---|---|---|
| 2,330,679 | A | * | 9/1943 | Church | 172/155 |
| 2,427,301 | A | * | 9/1947 | Puim | 414/642 |
| 2,432,653 | A | * | 12/1947 | Bloom | 56/400 |
| 2,476,183 | A | * | 7/1949 | Fergason | 56/377 |
| 2,494,684 | A | * | 1/1950 | Best | 414/712 |
| 2,514,560 | A | * | 7/1950 | Scranton | 56/400 |
| 2,514,561 | A | * | 7/1950 | Scranton | 56/377 |
| 2,518,303 | A | * | 8/1950 | Godley et al. | 56/11.2 |
| 2,525,090 | A | * | 10/1950 | Bott | 56/16.6 |
| 2,544,861 | A | * | 3/1951 | Rath | 56/400.14 |
| 2,549,086 | A | * | 4/1951 | Harrer | 403/379.4 |
| 2,554,680 | A | * | 5/1951 | Morris et al. | 206/374 |
| 2,573,054 | A | * | 10/1951 | Pearson | 56/16.1 |
| 2,584,348 | A | * | 2/1952 | Healy | 56/400.08 |
| 2,600,109 | A | * | 6/1952 | Gorton | 56/388 |
| 2,603,933 | A | * | 7/1952 | Shore | 56/12.4 |
| 2,618,917 | A | * | 11/1952 | Howser | 298/23 R |
| 2,641,099 | A | * | 6/1953 | Reynolds et al. | 56/121.46 |
| 2,645,891 | A | * | 7/1953 | Berkley | 56/10.9 |
| 2,670,089 | A | * | 2/1954 | Paterson | 414/703 |
| 2,676,719 | A | * | 4/1954 | Wagner et al. | 414/704 |
| 2,677,528 | A | * | 5/1954 | Dahl | 254/286 |
| 2,681,822 | A | * | 6/1954 | Daniels | 81/53.11 |
| 2,697,905 | A | * | 12/1954 | Moriarty | 56/400.01 |
| 2,700,976 | A | * | 2/1955 | Hopkins | 460/87 |
| 2,744,459 | A | * | 5/1956 | Craig | 172/58 |
| 2,766,577 | A | * | 10/1956 | Dorman | 56/400.17 |
| 2,791,340 | A | * | 5/1957 | Haines et al. | 414/699 |
| 2,847,816 | A | * | 8/1958 | Yeda | 56/400.17 |
| 2,865,161 | A | * | 12/1958 | Nygren | 56/249 |
| 2,866,309 | A | * | 12/1958 | Andor | 56/377 |
| 2,891,374 | A | * | 6/1959 | Richmond | 56/400.12 |
| 2,909,131 | A | * | 10/1959 | Baur | 425/374 |
| 2,934,229 | A | * | 4/1960 | Worden | 414/484 |
| 2,942,532 | A | * | 6/1960 | Pearce | 493/90 |
| 2,951,328 | A | * | 9/1960 | McCarty | 56/377 |
| 2,977,743 | A | * | 4/1961 | Giles | 56/377 |
| 2,996,111 | A | * | 8/1961 | Mocerino et al. | 126/401 |
| 2,996,869 | A | * | 8/1961 | Van Der Lely et al. | 56/377 |
| 3,095,682 | A | * | 7/1963 | Pasquine | 56/400.12 |
| 3,111,673 | A | * | 11/1963 | Henning | 227/8 |
| 3,127,728 | A | * | 4/1964 | Gehman | 56/400 |
| 3,145,921 | A | * | 8/1964 | Thienemann et al. | 234/102 |
| 3,163,945 | A | * | 1/1965 | Dooley | 37/405 |
| 3,193,837 | A | * | 7/1965 | Leonard et al. | 346/78 |
| 3,209,527 | A | * | 10/1965 | Rick | 56/400.04 |
| 3,217,481 | A | * | 11/1965 | Remy | 56/366 |
| 3,234,720 | A | * | 2/1966 | Blodgett | 56/400.05 |
| 3,240,005 | A | * | 3/1966 | Rowse | 56/386 |
| 3,264,809 | A | * | 8/1966 | Jackson | 56/400.12 |
| 3,267,656 | A | * | 8/1966 | Van Der Lely | 56/370 |
| 3,613,529 | A | * | 10/1971 | Stork et al. | 198/614 |
| 3,645,077 | A | * | 2/1972 | Hauser-Lienhard | 56/366 |
| 3,688,483 | A | * | 9/1972 | Hamilton | 56/400.11 |
| 3,688,484 | A | * | 9/1972 | Cox et al. | 56/400.12 |
| 3,702,638 | A | * | 11/1972 | Takata | 172/540 |
| 3,704,577 | A | * | 12/1972 | Reber | 56/370 |
| 3,753,341 | A | * | 8/1973 | Berg et al. | 56/400.04 |
| 3,777,460 | A | * | 12/1973 | Mokros | 56/16.7 |
| 3,782,482 | A | * | 1/1974 | Miller | 172/381 |
| 3,812,920 | A | * | 5/1974 | Green | 172/350 |
| 3,827,224 | A | * | 8/1974 | Mulder et al. | 56/370 |
| 3,828,386 | A | * | 8/1974 | Roth | 15/105 |
| 3,870,300 | A | * | 3/1975 | Amendola | 473/391 |
| 3,895,407 | A | * | 7/1975 | Parise | 15/397 |
| 3,916,607 | A | * | 11/1975 | Howard | 56/17.5 |
| 3,921,373 | A | * | 11/1975 | Rubin | 56/16.6 |
| 3,962,854 | A | * | 6/1976 | van der Lely et al. | 56/370 |
| 3,991,479 | A | * | 11/1976 | Dionne | 34/248 |
| 4,018,038 | A | * | 4/1977 | Sipe | 56/400.12 |
| 4,078,368 | A | * | 3/1978 | Binder | 56/400.01 |
| 4,089,379 | A | * | 5/1978 | Crownover | 172/370 |
| 4,128,266 | A | * | 12/1978 | Vaslas | 294/58 |
| 4,146,096 | A | * | 3/1979 | Rocker | 172/643 |
| 4,166,505 | A | * | 9/1979 | West | 171/1 |
| 4,189,008 | A | * | 2/1980 | Porter | 172/253 |
| 4,189,907 | A | * | 2/1980 | Erdman | 56/400 |
| 4,203,495 | A | * | 5/1980 | Crownover | 172/370 |
| 4,215,528 | A | * | 8/1980 | Fodor | 56/400.17 |
| 4,217,672 | A | * | 8/1980 | Olivari | 15/79.2 |
| 4,229,932 | A | * | 10/1980 | Persoons et al. | 56/13.5 |
| 4,231,688 | A | * | 11/1980 | Wolf | 406/76 |
| 4,254,609 | A | * | 3/1981 | van der Lely | 56/370 |
| 4,263,774 | A | * | 4/1981 | DeCoene | 56/370 |
| 4,270,614 | A | * | 6/1981 | Judy | 171/63 |
| 4,287,710 | A | * | 9/1981 | van der Lely | 56/372 |
| 4,297,760 | A | * | 11/1981 | Olivari | 15/79.1 |
| 4,312,095 | A | * | 1/1982 | Mullins | 56/400.14 |
| 4,406,113 | A | * | 9/1983 | Mullins | 56/400.16 |
| 4,446,681 | A | * | 5/1984 | Dynie et al. | 56/16.7 |
| 4,480,349 | A | * | 11/1984 | Barr | 15/4 |
| 4,492,271 | A | * | 1/1985 | Doering | 172/43 |
| 4,500,125 | A | * | 2/1985 | Olson | 294/1.4 |
| 4,502,806 | A | * | 3/1985 | Albertson | 401/137 |
| 4,545,189 | A | * | 10/1985 | Nelson | 56/400.12 |
| 4,635,987 | A | * | 1/1987 | Hurtgam | 294/19.2 |
| 4,649,698 | A | * | 3/1987 | Sykora | 56/400.17 |
| 4,730,864 | A | * | 3/1988 | Sample | 294/50.9 |
| 4,757,672 | A | * | 7/1988 | Roger | 56/192 |
| 4,776,157 | A | * | 10/1988 | van der Lely et al. | 56/377 |
| 4,785,614 | A | * | 11/1988 | Schoenherr | 56/365 |
| 4,843,667 | A | * | 7/1989 | Hanly, Sr. | 7/114 |
| 4,850,185 | A | * | 7/1989 | Dimon | 56/400.1 |
| 4,864,809 | A | * | 9/1989 | van der Lely et al. | 56/377 |
| 4,866,922 | A | * | 9/1989 | Clark | 56/400.04 |
| 4,910,893 | A | * | 3/1990 | Asay | 37/281 |
| 5,033,142 | A | * | 7/1991 | Templeton | 7/167 |
| 5,054,151 | A | * | 10/1991 | Estes, Sr. | 15/79.2 |
| 5,060,343 | A | * | 10/1991 | Nisenbaum | 16/421 |
| 5,065,475 | A | * | 11/1991 | Watt | 16/426 |
| 5,079,864 | A | * | 1/1992 | Roy | 37/302 |
| 5,146,997 | A | * | 9/1992 | Korin | 172/42 |
| 5,165,144 | A | * | 11/1992 | Nisenbaum | 16/421 |
| 5,189,868 | A | * | 3/1993 | Hill | 56/13.3 |
| 5,230,385 | A | * | 7/1993 | Dinatale | 172/378 |
| 5,246,260 | A | * | 9/1993 | Racicot | 294/19.2 |
| 5,305,591 | A | * | 4/1994 | Gibson, Jr. | 56/400.1 |
| 5,331,720 | A | * | 7/1994 | Beckingham | 16/426 |
| 5,337,443 | A | * | 8/1994 | Steinberg et al. | 15/344 |
| 5,357,739 | A | * | 10/1994 | Nuss | 56/400.14 |
| 5,388,878 | A | * | 2/1995 | Smith | 294/15 |
| 5,390,746 | A | * | 2/1995 | Page | 172/371 |
| 5,432,955 | A | * | 7/1995 | Plotka et al. | 2/181 |
| 5,437,146 | A | * | 8/1995 | Erickson | 56/330 |
| 5,465,510 | A | * | 11/1995 | Goodnough et al. | 37/285 |
| 5,467,590 | A | * | 11/1995 | Mencarelli et al. | 56/400.17 |
| 5,493,850 | A | * | 2/1996 | Torkelson | 56/8 |
| 5,498,046 | A | * | 3/1996 | Ridley et al. | 294/1.1 |
| 5,499,852 | A | * | 3/1996 | Seigendall | 294/58 |
| 5,501,069 | A | * | 3/1996 | Lentz | 56/400.1 |
| 5,516,242 | A | * | 5/1996 | Andronica | 408/59 |
| 5,516,305 | A | * | 5/1996 | Haluska | 439/484 |
| 5,522,209 | A | * | 6/1996 | Petruzzelli | 56/400.16 |
| 5,522,629 | A | * | 6/1996 | Loo | 294/51 |
| 5,529,357 | A | * | 6/1996 | Hoffman | 294/58 |
| 5,564,266 | A | * | 10/1996 | Laughlin | 56/400.12 |
| 5,603,137 | A | * | 2/1997 | Hasan | 15/176.1 |
| 5,640,985 | A | * | 6/1997 | Snyder et al. | 135/65 |
| 5,687,556 | A | * | 11/1997 | Lintz | 56/400.01 |
| 5,700,531 | A | * | 12/1997 | Gillberg-LaForce et al. | 428/36.1 |
| 5,713,193 | A | * | 2/1998 | Stapley et al. | 56/400.08 |
| 5,762,240 | A | * | 6/1998 | Harris | 223/1 |
| 5,765,351 | A | * | 6/1998 | Frankhouser | 56/400.12 |
| 5,813,206 | A | * | 9/1998 | McKittrick | 56/400.01 |
| 5,836,087 | A | * | 11/1998 | Wilson et al. | 34/528 |
| 5,911,671 | A | * | 6/1999 | Heitstuman | 56/16.4 R |
| 5,922,139 | A | * | 7/1999 | Gilbert | 134/6 |
| 5,930,862 | A | * | 8/1999 | Garrett | 15/200 |
| 5,937,473 | A | * | 8/1999 | Lisowski | 15/236.08 |
| 5,937,627 | A | * | 8/1999 | McKittrick | 56/400.01 |
| 5,960,889 | A | * | 10/1999 | McLaren | 172/37 |
| 5,974,771 | A | * | 11/1999 | Greenan | 56/16.7 |
| 5,987,864 | A | * | 11/1999 | Lutz | 56/377 |
| 6,004,234 | A | * | 12/1999 | Majchrowicz | 473/560 |
| 6,018,894 | A | * | 2/2000 | Whitehead et al. | 37/285 |
| 6,216,796 | B1 | * | 4/2001 | Frank et al. | 172/684.5 |

| | | | | |
|---|---|---|---|---|
| 6,241,025 | B1 * | 6/2001 | Myers et al. | 172/21 |
| 6,272,827 | B1 * | 8/2001 | Hsu | 56/400.12 |
| 6,302,788 | B1 * | 10/2001 | Gagnon | 454/367 |
| 6,311,465 | B1 * | 11/2001 | Stuart | 56/400.12 |
| 6,339,314 | B1 * | 1/2002 | Bruning | 320/128 |
| 6,391,138 | B1 * | 5/2002 | Bablee et al. | 156/253 |
| 6,408,606 | B1 * | 6/2002 | Hsu | 56/400.04 |
| 6,415,872 | B2 * | 7/2002 | Myers et al. | 172/21 |
| 6,502,381 | B2 * | 1/2003 | Crites | 56/400.12 |
| 6,591,716 | B2 * | 7/2003 | Wantz | 81/53.1 |
| 6,655,053 | B1 * | 12/2003 | Cummungs | 37/403 |
| 6,748,728 | B2 * | 6/2004 | Hay | 56/8 |
| 6,772,538 | B2 * | 8/2004 | Vagedes | 34/606 |
| 6,904,743 | B2 * | 6/2005 | Vodinh | 56/400.04 |
| 6,962,595 | B1 * | 11/2005 | Chamness et al. | 606/153 |
| 7,044,520 | B2 * | 5/2006 | Roberson et al. | 294/55.5 |
| 7,065,905 | B2 * | 6/2006 | Guinibert et al. | 34/603 |
| 7,097,766 | B2 * | 8/2006 | Moya | 210/272 |
| 7,131,255 | B1 * | 11/2006 | Caneba | 56/400.19 |
| 7,363,755 | B1 * | 4/2008 | Caneba | 56/400.19 |
| 7,378,052 | B2 * | 5/2008 | Harryson | 419/7 |
| 2001/0001199 | A1 * | 5/2001 | Sabounjian | 211/202 |
| 2001/0010125 | A1 * | 8/2001 | Bier | 34/322 |
| 2001/0048267 | A1 * | 12/2001 | Albaizar et al. | 312/236 |
| 2002/0017117 | A1 * | 2/2002 | Sunshine et al. | 68/3 R |
| 2002/0062574 | A1 * | 5/2002 | Volpenhein et al. | 34/108 |
| 2002/0096913 | A1 * | 7/2002 | Moriaux | 296/190.02 |
| 2002/0108268 | A1 * | 8/2002 | Helmer | 34/600 |
| 2003/0084585 | A1 * | 5/2003 | Tomasi et al. | 34/90 |
| 2003/0115915 | A1 * | 6/2003 | Nitschmann et al. | 68/139 |
| 2003/0133822 | A1 * | 7/2003 | Harryson | 419/35 |
| 2003/0150126 | A1 * | 8/2003 | Chang et al. | 34/96 |
| 2003/0164348 | A1 * | 9/2003 | Seng | 211/196 |
| 2003/0221399 | A1 * | 12/2003 | Hall | 56/2 |
| 2003/0233766 | A1 * | 12/2003 | Bolduan et al. | 34/335 |
| 2003/0235470 | A1 * | 12/2003 | Gelb et al. | 404/133.1 |
| 2004/0031295 | A1 * | 2/2004 | Choi | 68/24 |
| 2004/0074105 | A1 * | 4/2004 | Vagedes | 34/606 |
| 2004/0074858 | A1 * | 4/2004 | Thuma et al. | 211/202 |
| 2004/0084602 | A1 * | 5/2004 | Heyder et al. | 248/674 |
| 2004/0134087 | A1 * | 7/2004 | Meyer | 34/90 |
| 2004/0134088 | A1 * | 7/2004 | Meyer | 34/90 |
| 2004/0134237 | A1 * | 7/2004 | Sunshine et al. | 68/3 R |
| 2004/0159009 | A1 * | 8/2004 | Hwang | 34/601 |
| 2004/0238430 | A1 * | 12/2004 | Moya | 210/280 |
| 2004/0263032 | A1 * | 12/2004 | Cho | 312/330.1 |
| 2004/0264097 | A1 * | 12/2004 | Babbitt et al. | 361/212 |
| 2005/0014673 | A1 * | 1/2005 | Kwitkowski et al. | 510/515 |
| 2005/0016520 | A1 * | 1/2005 | Freese et al. | 126/91 A |
| 2005/0045350 | A1 * | 3/2005 | Roberson et al. | 172/378 |
| 2005/0050766 | A1 * | 3/2005 | Freese et al. | 34/604 |
| 2005/0103966 | A1 * | 5/2005 | Kim | 248/346.05 |
| 2005/0120585 | A1 * | 6/2005 | Lee et al. | 34/602 |
| 2005/0125910 | A1 * | 6/2005 | Guinibert et al. | 8/158 |
| 2005/0126177 | A1 * | 6/2005 | Primlani | 60/776 |
| 2005/0127265 | A1 * | 6/2005 | Giovinazzi | 248/673 |
| 2005/0150128 | A1 * | 7/2005 | Wuster | 34/239 |
| 2005/0172510 | A1 * | 8/2005 | Cimetta et al. | 34/603 |
| 2005/0172631 | A1 * | 8/2005 | Primlani | 60/698 |
| 2005/0223592 | A1 * | 10/2005 | Hong | 34/601 |
| 2005/0277505 | A1 * | 12/2005 | Wong et al. | 474/111 |
| 2006/0042114 | A1 * | 3/2006 | Robson et al. | 34/90 |
| 2006/0059882 | A1 * | 3/2006 | Schneider | 56/400.12 |
| 2006/0070753 | A1 * | 4/2006 | Lephart et al. | 172/41 |
| 2006/0101662 | A1 * | 5/2006 | Ackermann et al. | 34/86 |
| 2006/0117480 | A1 * | 6/2006 | Younce | 5/417 |
| 2006/0130243 | A1 * | 6/2006 | Ozaltin et al. | 8/158 |
| 2006/0137206 | A1 * | 6/2006 | Lee et al. | 34/86 |
| 2006/0236670 | A1 * | 10/2006 | Glasford et al. | 56/257 |
| 2006/0236671 | A1 * | 10/2006 | Summerville et al. | 56/378 |
| 2006/0248746 | A1 * | 11/2006 | Dittmer et al. | 34/534 |
| 2006/0272168 | A1 * | 12/2006 | Parks | 34/104 |
| 2007/0012638 | A1 * | 1/2007 | Van Eijk | 211/104 |
| 2007/0068034 | A1 * | 3/2007 | Kim | 34/499 |
| 2007/0101605 | A1 * | 5/2007 | Susalla | 34/202 |
| 2007/0101609 | A1 * | 5/2007 | Jerg et al. | 34/416 |
| 2007/0119071 | A1 * | 5/2007 | Ackermann et al. | 34/322 |
| 2007/0128899 | A1 * | 6/2007 | Mayer | 439/152 |
| 2007/0227030 | A1 * | 10/2007 | Oh et al. | 34/60 |
| 2007/0227035 | A1 * | 10/2007 | Leroy | 34/602 |
| 2007/0266588 | A1 * | 11/2007 | Maniha | 34/236 |
| 2007/0289283 | A1 * | 12/2007 | Hanas | 56/400.14 |
| 2008/0022550 | A1 * | 1/2008 | Masters | 34/480 |
| 2008/0047078 | A1 * | 2/2008 | Gully | 8/158 |
| 2008/0047159 | A1 * | 2/2008 | Mackay | 34/82 |
| 2008/0104780 | A1 * | 5/2008 | Dayton et al. | 15/22.1 |
| 2008/0104856 | A1 * | 5/2008 | Armstrong | 34/60 |
| 2008/0168933 | A1 * | 7/2008 | Setko | 111/92 |
| 2008/0173138 | A1 * | 7/2008 | Dayton et al. | 81/53.1 |
| 2008/0177994 | A1 * | 7/2008 | Mayer | 713/2 |
| 2008/0189870 | A1 * | 8/2008 | Dayton et al. | 7/167 |
| 2008/0202091 | A1 * | 8/2008 | Bundy | 56/229 |
| 2008/0235978 | A1 * | 10/2008 | Epstein | 34/82 |
| 2008/0250570 | A1 * | 10/2008 | Dayton et al. | 7/170 |
| 2008/0256826 | A1 * | 10/2008 | Zarembinski | 34/562 |
| 2008/0282569 | A1 * | 11/2008 | Roberts | 34/82 |
| 2008/0284181 | A1 * | 11/2008 | Taylor | 292/256 |
| 2008/0302546 | A1 * | 12/2008 | Bundy | 172/22 |
| 2009/0020520 | A1 * | 1/2009 | Forget | 219/461.1 |
| 2009/0064534 | A1 * | 3/2009 | LeClerc | 34/603 |
| 2009/0083987 | A1 * | 4/2009 | Prajescu | 34/130 |
| 2009/0083991 | A1 * | 4/2009 | Prajescu | 34/601 |
| 2009/0083992 | A1 * | 4/2009 | Prajescu et al. | 34/601 |
| 2009/0090018 | A1 * | 4/2009 | Stein | 34/60 |
| 2009/0229236 | A1 * | 9/2009 | Schumacher et al. | 56/400.21 |

FOREIGN PATENT DOCUMENTS

| | | | |
|---|---|---|---|
| DE | 3610136 | A1 * | 10/1987 |
| EP | 252187 | A2 * | 1/1988 |
| EP | 283530 | A1 * | 9/1988 |
| FR | 2561486 | A2 * | 9/1985 |
| FR | 2567351 | A1 * | 1/1986 |
| GB | 2208156 | A * | 3/1989 |
| GB | 2248034 | A * | 3/1992 |
| GB | 2259663 | A * | 3/1993 |
| GB | 2278798 | A * | 12/1994 |
| GB | 2390286 | A * | 1/2004 |
| GB | 2397042 | A * | 7/2004 |
| JP | 02077299 | A * | 3/1990 |
| JP | 02200103 | A * | 8/1990 |
| JP | 03097499 | A * | 4/1991 |
| JP | 03186489 | A * | 8/1991 |
| JP | 04152995 | A * | 5/1992 |
| JP | 06023197 | A * | 2/1994 |
| JP | 07241778 | A * | 9/1995 |
| JP | 08010498 | A * | 1/1996 |
| JP | 10085495 | A * | 4/1998 |
| JP | 10121792 | A * | 5/1998 |
| JP | 10178865 | A * | 7/1998 |
| JP | 10226483 | A * | 8/1998 |
| JP | 11056129 | A * | 3/1999 |
| JP | 2000094365 | A * | 4/2000 |
| JP | 2002199801 | A * | 7/2002 |
| JP | 2010024816 | A * | 2/2010 |
| WO | WO 9635322 | A1 * | 11/1996 |
| WO | WO 2004066711 | A2 * | 8/2004 |

* cited by examiner

CLOTHES DRYER RAKE

TECHNICAL FIELD

The present invention relates generally to apparatuses for extending the reach of a person and more specifically to retrieving articles which have been dropped, pushed, or rolled into areas not generally easily accessible.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers.

DETAILED DESCRIPTION OF EMBODIMENTS OF THE INVENTION

Typically, many people doing laundry have encountered problems removing clothes from a clothes dryer. It is often typical to find a dryer located in a corner of a small room such as a small utility room wherein the door of the dryer cannot be fully swung open or can only be partially opened. Further, the dryer may be located in a low position, such as but not limited to situations wherein the dryer is small and placed directly on a floor or a recessed floor, or in a high position, such as but not limited to situations wherein a dryer is stacked atop a washing machine or on top of one or more other dryers. Still further, a dryer may be particularly hot after longer drying cycles. Each of these situations, as well as other imaginable situations often prevents easy retrieval of articles from within the dryer Many times due to the positioning of the dryer or the location of the door one must substantially insert ones head or part of their upper body into the dryer to reach some of the articles left in the back of the dryer or if the dryer is in a high position, it is often impossible to reach all the way to the back of the dryer. The similar situation, i.e not being able to reach an article of clothing, may occur when one has articles that have fallen behind a bed, dresser, desk or the like and the article is beyond the arms reach of a person. The presently described apparatus can be used similarly to a rake to retrieve the articles in that are stuck in a dryer or beyond ones reach in a dryer, under a bed, behind desk or in any other inaccessible place. It should be understood that although many of the descriptions, hereinbelow, refer to the use of the apparatus in and around dryers, furniture, and for various household purposes, this apparatus is readily adaptable for other purposes including, but not limited to, industrial applications, commercial applications, outdoor applications, and the like. Thus, the embodiments described hereinbelow should not be viewed as being limited to household applications as those in the art will see how simple adaptations, particularly of size and or materials of construction can adapt the instant apparatus for many applications.

Figure 1:
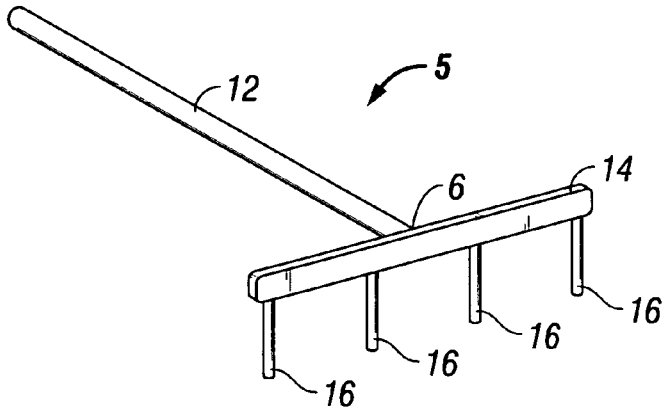
FIG. 1 illustrates an embodiment of the apparatus in accordance to the present invention.
Figure 2:
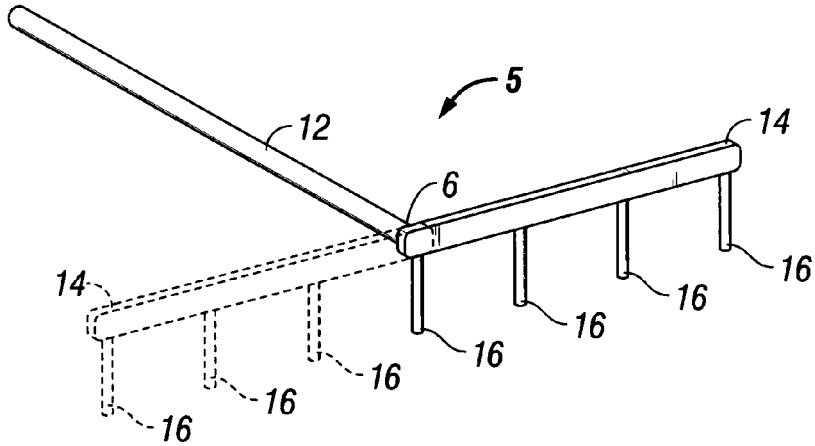
FIG. 2 illustrates an embodiment of the head of the apparatus in accordance with the present invention.

As illustrated in FIG. 1, the instant apparatus 5 preferably has a long handle 12 and an head 14, attached to one end. The head 14 may be integral to the handle 12, may be detachable from the handle 12, or may be rotatably mounted onto the handle 12. It should be appreciated that handle 12 can be of a variety of lengths and materials. It is preferable for the handle 12 and the head 14 to be of a lightweight construction to allow for easy use. However, the handle 12 and head 14 should be sturdy enough to allow for the handling of any articles intended to be picked up or dragged. Further, it should be appreciated that the handle 12 can be straight, curved, angled, or any combination thereof. Preferably the head 14 will have members, fingers, or tines 16 which extend outwardly and/or curved or angled away from the head 14. It should be appreciated that the number and size of the tines 16 can be varied without departing from the scope of the invention. Further, it is contemplated that the tines 16 can be replaceable to avoid having to replace the head if only the tines 16 are damaged. For the replacement of the tines 16, it is contemplated that the replacement fingers could be threaded, could be insertable in a hole, could be attached by screws or pins, could be attached by a glue, or any other conventional method of a replaceable attachment. The head 14 may be substantially perpendicular to the handle 12 and extend outwardly from the handle an equal distance on each side. However, it should be appreciated that the head 14 can be mounted so that the entire head 14 extends perpendicularly from one end or the other of the handle end 6 (see FIG. 2). It should be further appreciated that the head 14 can be curved. Particularly if being used in a dryer the head 14 can be curved to substantially match the interior curvature of a conventional dryer (see FIG. 2B).

Figure 2A:
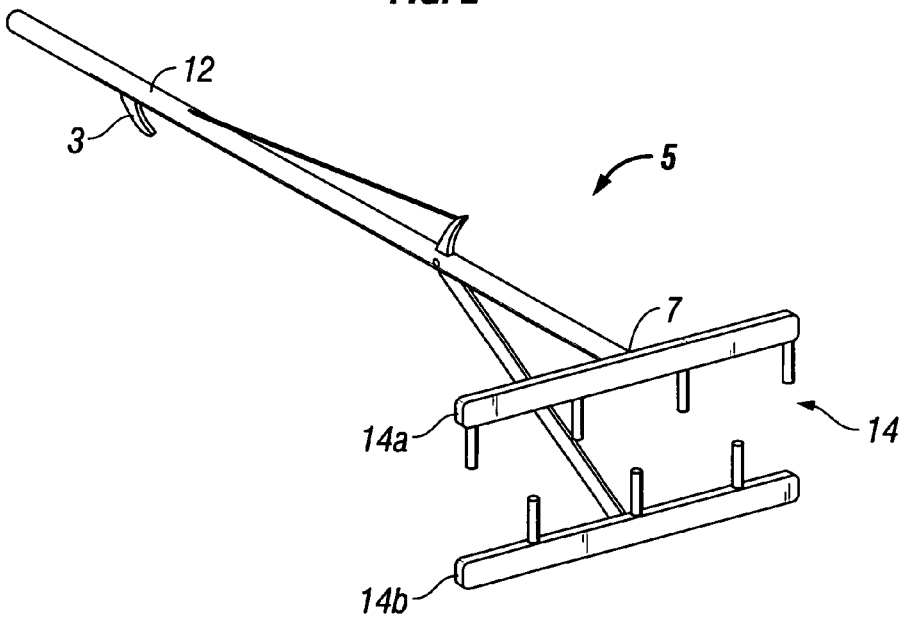
FIG. 2A illustrates an embodiment of the head of the apparatus in accordance with the present invention.
Figure 2B:
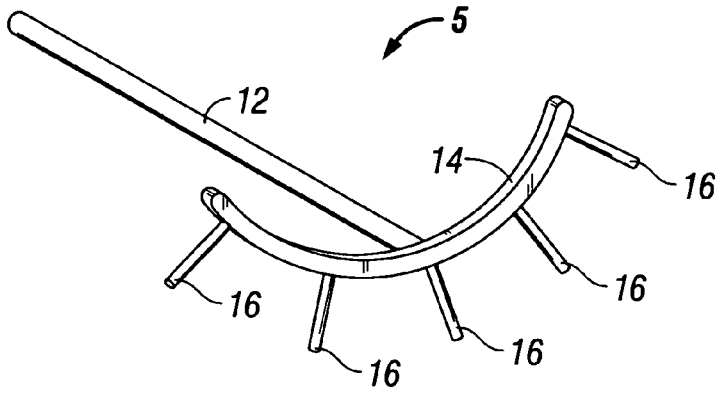
FIG. 2B illustrates an embodiment of the head of the apparatus in accordance with the present invention.

FIG. 2A illustrates another embodiment, wherein the head comprises at least two sections or jaws 14*a*, 14*b*, which grasp the articles or articles to be retrieved between the two jaws 14 *a*, 14*b*. The upper section or jaw includes a first head that is perpendicular to a first elongate member or handle. The first head includes a first plurality of stationary members that are spaced evenly along a single plane and are arranged perpendicular to the first head, such that the arrangement of the first elongate member, the first head, and the first plurality of stationary members of the upper section or jaw are, each, at right angles to the other to form an orthogonal system with each other. The lower section or jaw, as depicted in FIG. 2A, includes a second elongate member that is movably attached to the first elongate member or handle, such that the second elongate member can be raised or lowered with respect to the upper section or jaw for grasping an article or many articles. The lower section or jaw includes a second head that is perpendicular to the second elongate member. The second head includes a second plurality of stationary members that are spaced evenly along a single plane and are arranged perpendicular to the second head, such that the arrangement of the second elongate member, the second head, and the second plurality of stationary members of the lower section or jaw are, each, at right angles to the other to form an orthogonal system with each other. The plurality of stationary members or tines on the upper section or jaw can be heavier, larger, or spaced differently as compared to the plurality of stationary members or tines on the lower section or jaw, or vice versa, for grasping and retrieving articles, such as clothes in a dryer. It should be appreciated that the actuation of the jaws 14*a*, 14*b* can be mechanical or powered or any combination thereof. Preferably, the actuation would comprise a trigger and release 3, which may be a button, a trigger, or other conventional device which opens and closes the jaws 14*a*, 14*b*. Preferably, the actuation linkage (not shown) would be contained inside the handle 12 and would operate the jaws 14*a*, 14*b* at or near the connection between the handle 12 and the head 14, designated for understanding with the numeral 7. It should also be appreciated that for ease of manufacturing and to maintain an economic cost, the actuation linkage could be mounted external to the handle 12 in a conventional manner.

Figure 2C:
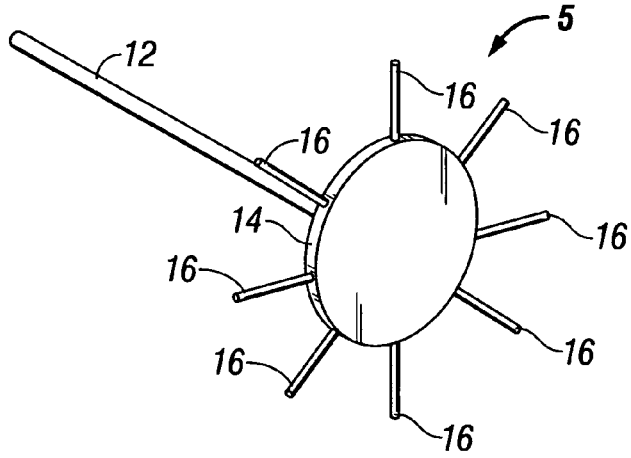
FIG. 2C illustrates an embodiment of the head of the apparatus in accordance with the present invention.

FIG. 2C illustrates another embodiment wherein the head 14 can be a substantially round shape. In this embodiment, the tines 16 would preferably extend outwardly from the head 14. As discussed hereinbelow, the tines 16 can be of the same size or can have different sizes/strengths for dragging larger or heavier objects. It is further contemplated that the tines 16 can be replaceable and can also be adjustable in order to more custom fit a dryer drum.

Figure 3:
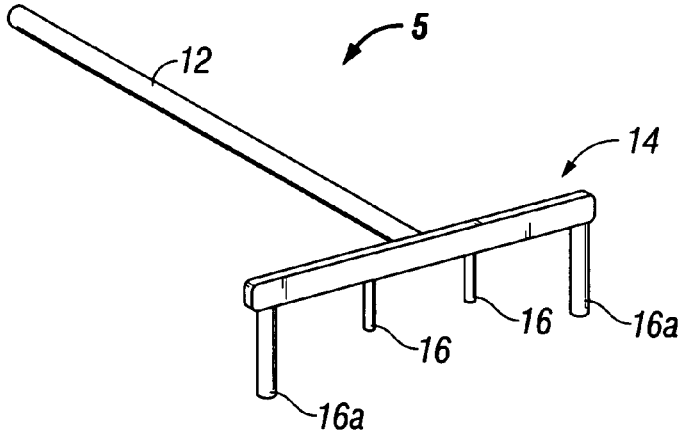
FIG. 3 illustrates an embodiment of the head of the apparatus in accordance with the present invention.

In another embodiment the members or tines 16 of the head 14 can be of various sizes For example as illustrated in FIG. 3 and not intended as being limiting, the members or tines 16*a*, on the ends of the head 14 could be heavier or larger then the tines 16 on the internal section of the head 14. This difference in member size or weight would allow one to be able to hook heavier or larger objects and rake them in. The smaller or lighter objects could be pulled in or raked in using the lighter or smaller tines 16 on the head 14. It should be appreciated that the heavier tines 16 do not have to be at opposite ends of the head 14 but could be placed at any position along the head 14.

Figure 4:
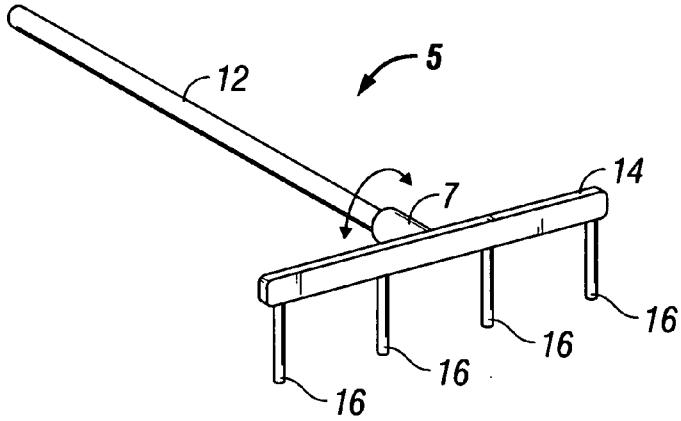
FIG. 4 illustrates an embodiment of the connection between the apparatus and the head in accordance with the present invention.

As illustrated in FIG. 4, another embodiment the head 14 is attached to the handle 12 via a rotatable or swiveling joint 7. Thus, the head 14 could rotate about the handle 12. It should be understood that the swivel joint 7 can be any variety of conventional connections that allow rotation. Further, the rotation can be free, can be have several manually locking set positions, can have set positions which are overcome with additional pressure (such as but not limited to corresponding bumps and grooves which allow the position to be set during the rotation but overcome with additional torque), or any combination thereof. It should be appreciated that the swiveling or rotating does not have to be limited to rotation in a single plane but could include tilting so as to allow rotation in various planes. Thus, if one is trying to reach articles in a different position the head or head 14 can be rotated to reach upper areas as well as lower areas.

Figure 5:
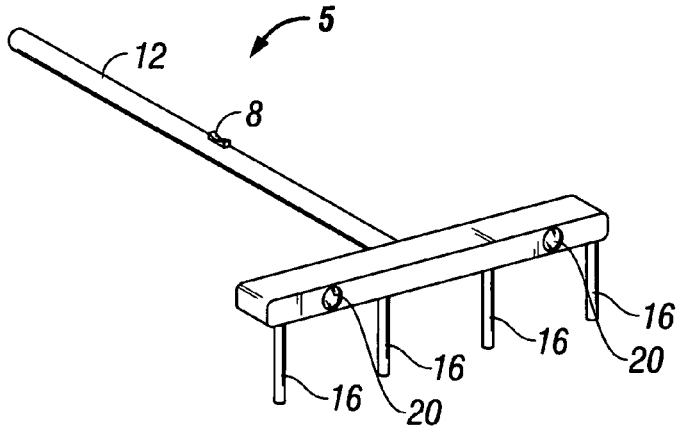
FIG. 5 illustrates an embodiment of the head of the apparatus in accordance with the present invention.

FIG. 5 illustrates another embodiment wherein the head 14 has one or more lights 20 disposed about the front, sides, back, or any other desired location of the head 14 so that if the apparatus 5 is being used in inaccessible and/or dark places, the light provides illumination. The light or lights are preferably activated by a switch 8. However, the light or lights can be permanently activated or can be activated in alternative manners such as, but not limited to, foot switches, different positioned switches, light sensor switches (i.e. only turns on when dark), or other activation mechanisms. It should be appreciated that such a light 20 could be battery powered, could have rechargeable batteries, could be electrically powered, solar powered, or any other method of power or any combination of methods of power.

Figure 6:
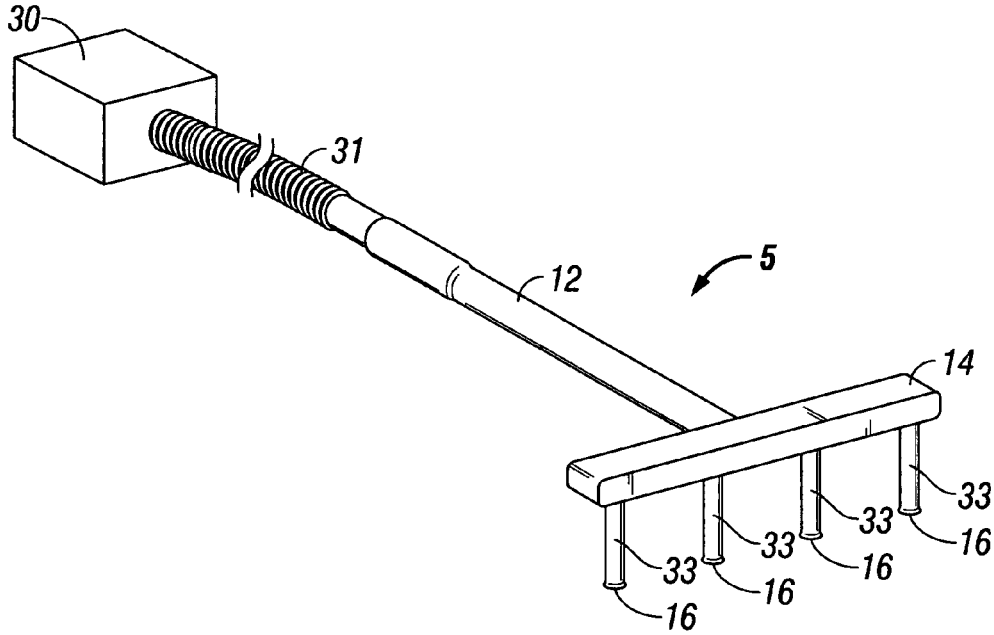
FIG. 6 illustrates an embodiment of the apparatus in accordance with the present invention.

FIG. 6 illustrates another embodiment wherein the handle 12 is attached to a vacuum device 30 via hose 31. This embodiment preferably has holes 33 located in the tines 16. Thus, the vacuum suction can aid in the retrieving or removing of unreachable articles. Preferably the holes 33 are small enough, or are fitted with some type of screening device, to prevent the articles being picked up from entering, becoming stuck in, or being damaged by the vacuum suction. It should be appreciated that the holes 33 can be located in other position about the head 14 or the handle 12. It should also be appreciated that secondary holes may be available for opening when the primary holes 33 are blocked. Thus, the vacuum device will not be damaged or destroyed by having all holes 33 blocked. It should be understood that the vacuum source may a type of conventional vacuum, may be a small unit integral with apparatus 5, or any combination thereof.

In another embodiment of apparatus 5, the head 14 is completely removable and can be replaced with another head so that various heads for various purposes such as, but not limited to, getting heavy objects from under furniture such as a bed, getting objects from within a small space, such as between appliances and walls or from under appliances, or for reaching objects such as on top of shelves, appliances, covers, furniture, and the like above or below such shelves, appliances, furniture or the like.

Figure 7:
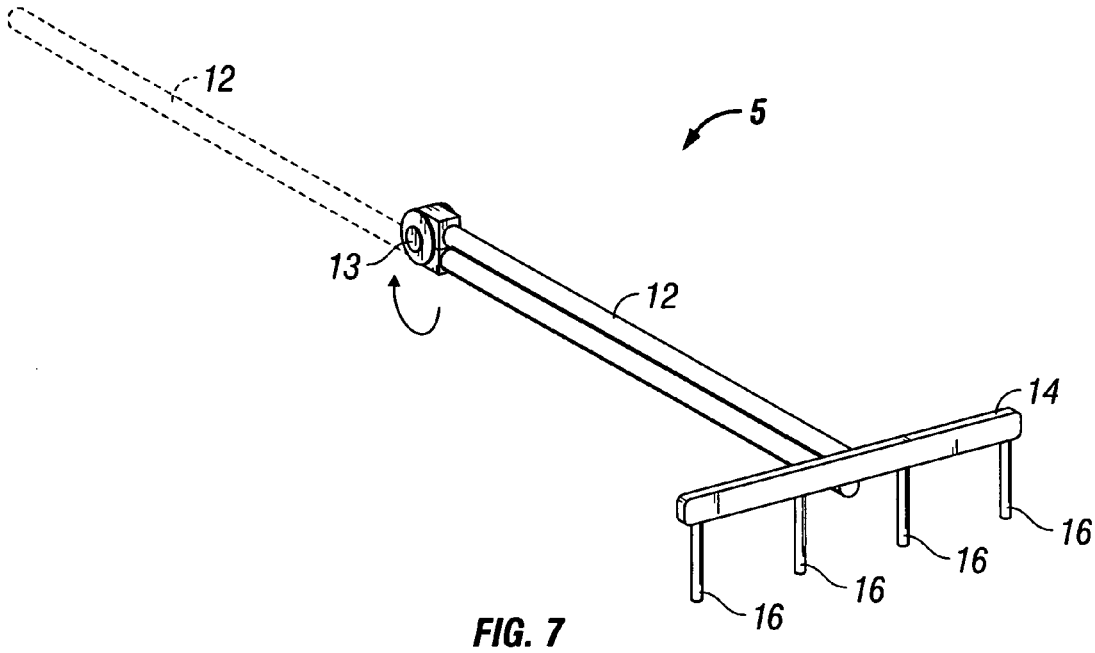
FIG. 7 illustrates an embodiment of the apparatus in accordance with the present invention.

FIG. 7 illustrates another embodiment, wherein the handle 12 is foldable having one or more joints 13 so that the devise 5 can be folded into a smaller apparatus and thus easily stored. It should be appreciated that the joint 13 can be of a variety of conventional joints, including but not limited to, complete disconnection that allow the handle 12 to be folded into one or more smaller sections. Further, it should be appreciated that the joints could allow the handle 12 to be positioned in one or more intermediate positions, between the fully extended and the fully folded position.

Figure 8:
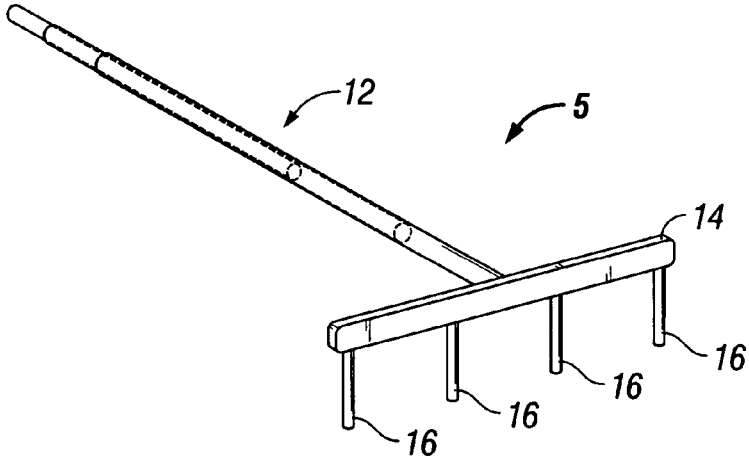
FIG. 8 illustrates an embodiment of the apparatus in accordance with the present invention.

FIG. 8 illustrates another embodiment wherein the handle 12 can be telescoping so again it can be folded into a smaller apparatus and stored easily. The telescoping mechanism can be spring loaded so as to work on a push button or it can be manually telescoped. It should be appreciated that the telescoping apparatus could comprise each section having dimples so as to allow the handle to remain in the retracted position until someone is ready to de-telescope it into its smaller shape. Further, the dimples may be locked by turning or simply popping into a recess. It should be appreciated that the direction of telescoping, i.e. having the largest section at the top or the bottom is fully contemplated herein and should not be viewed as a limitation thereof.

Figure 9:
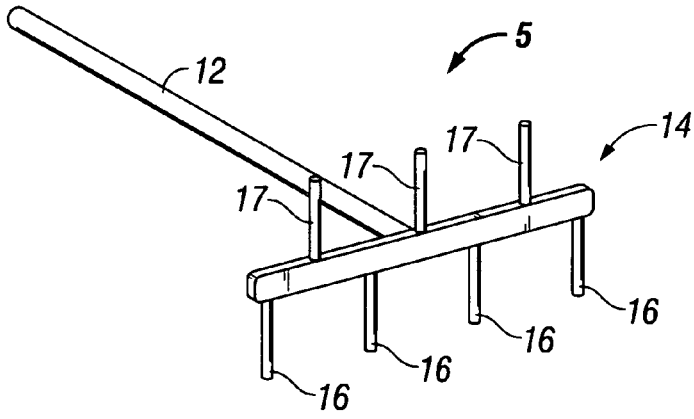
FIG. 9 illustrates an embodiment of the head of the apparatus in accordance with the present invention.

FIG. 9 illustrates another embodiment of the head 14 wherein the fingers 17 can be positioned substantially 180 degrees opposite the tines 16. In FIG. 9, the head is arranged perpendicular to the elongate member or handle. The head includes a first plurality of stationary members or first tines that are spaced evenly along a single plane and are arranged perpendicular to the head, and a second plurality of stationary members or second tines are spaced evenly along a single plane, wherein the second plurality of stationary members or second tines are arranged perpendicular to the head and substantially 180 degrees opposite the first plurality of stationary members or first tines. The arrangement of the elongate member, the head, and the first plurality of stationary members or tines are arranged at right angles to each other to form an orthogonal system with each other for grasping articles. In addition, the arrangement of the elongate member, the head, and the second plurality of stationary members or tines are arranged at right angles to each other to form an orthogonal system with each other for grasping articles. It is further contemplated that the tines 17 (or tines 16) could be of a heavier weight or larger size. Thus, one side of the device 5 could be used for retrieving lighter objects and the other side can be used for heavier object retrieval.

For ease of storage, it is contemplated that the handle 12 and/or the head 14 have a magnetic strip or section attached to, or integral with, the apparatus 5 thus allowing attachment of the apparatus 5 to a magnetic surface such as a dryer, refrigerator, stove, cabinet, shelf, or the like. Further, the handle 12 and/or head 14 could be coated with a non-stick, non-slip, and/or non-scratching surface or any combination thereof so as to prevent damage when using the rake inside the dryer or against any other appliance wherein scratching the appliance is a concern.

It will be understood that certain features and sub-combinations are of utility and may be employed without reference to other features and sub-combinations. This is contemplated by and is within the scope of the claims. It may be seen from the preceding description that a novel apparatus for retrieving unreachable articles has been provided. Although specific examples may have been described and disclosed, the invention of the instant application is considered to comprise and is intended to comprise any equivalent structure and may be constructed in many different ways to function and operate in the general manner as explained hereinbefore. Accordingly, it is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An apparatus for retrieving at least one article from a clothes dryer, the apparatus comprising:

an elongate member having a longitudinal axis, a first end, and a second end;

said first end being configured so as to be easily grasped;

said second end having a head detachably mounted thereto, wherein said head is positioned perpendicular to said longitudinal axis of said elongate member, and wherein said head passes through an opening of the clothes dryer while said head retains the ability to move within the clothes dryer by manipulating said first end;

said head having a first plurality of members, adapted to engage the at least one article within the clothes dryer, the first plurality of members extending perpendicular to said head in a first direction, wherein said first plurality of members are equally spaced in a single plane along said head and are arranged perpendicular to said longitudinal axis of said elongate member; and said head having a second plurality of members, adapted to engage the at least one article within the clothes dryer, the second plurality of members extending perpendicular to said head, wherein said second plurality of members extend in a second direction 180 degrees from the first direction, are equally spaced in a single plane along said head, and are arranged perpendicular to said longitudinal axis of said elongate member.

2. The apparatus of claim 1, wherein said plurality of members extending from said head are removably attached to said head.

3. The apparatus of claim 1, wherein said plurality of members extending outwardly further comprise at least two members extending outwardly from a right side and a left side from said head being larger than a plurality of members extending from a central portion of said head, said at least two members being adapted to engage the at least one article within the clothes dryer.

4. The apparatus of claim 1, wherein said plurality of members extending outwardly further comprise at least one member extending outwardly from said head being larger than the rest of said plurality of members extending from said head, said at least one member being adapted to engage the at least one article within the clothes dryer.

5. The apparatus of claim 1, wherein said plurality of members extending outwardly are adjustable in length.

6. The apparatus of claim 1, wherein said head is substantially curved so as to match an interior curvature of a clothes dryer.

7. The apparatus of claim 1, wherein said elongate member further comprises at least one telescoping section.

8. The apparatus of claim 7, wherein the telescoping section is spring-actuated and extends automatically when a button is depressed.

9. The apparatus of claim 1, wherein said head has a light source mounted on said head for illuminating an interior of the clothes dryer, wherein said light source, at least in part, illuminates an area in front of said head.

10. The apparatus of claim 1, wherein said head is rotatably mounted to said elongate member.

11. The apparatus of claim 1, wherein said head is swivelably mounted to said elongate member.

12. The apparatus of claim 1, wherein said head is rotatably and swivelably mounted to said elongate member.

13. The apparatus of claim 1, wherein said elongate member further comprises at least one pivotable point wherein said elongate member can be folded about said at least one pivotable point.

14. The apparatus of claim 1, wherein said elongate member and/or said head are coated so as to prevent sticking, slipping, and/or scratching or otherwise damaging an interior of the clothes dryer or objects or articles which said apparatus contacts.

15. The apparatus of claim 1, wherein said elongate member and/or said head further comprise a magnetic surface, wherein said magnetic surface can attach said apparatus to a magnetically attractive surface.

16. The apparatus of claim 1, wherein said head is configured to grasp at least one article to be retrieved.

17. The apparatus of claim 1, further comprising a vacuum source in communication with said head, wherein said vacuum source provides a suction pressure to said head.

* * * * *